United States Patent [19]

Lawrence et al.

[11] 4,162,106

[45] Jul. 24, 1979

[54] PNEUMATIC VEHICLE WITH CENTRALLY MOUNTED GUIDE MEANS

[76] Inventors: Leo B. Lawrence, Tollgate Rd., Pipersville 18947; Joseph Del Rossi, 465 Elm Ave., Churchville, Pa. 18966

[21] Appl. No.: 874,383

[22] Filed: Feb. 2, 1978

Related U.S. Application Data

[63] Continuation-in-part of Ser. No. 730,337, Oct. 7, 1976, abandoned.

[51] Int. Cl.[2] ..... A63H 29/16

[52] U.S. Cl. ..... 406/185; 46/44; 46/216; 406/190

[58] Field of Search ..... 46/44, 216; 276/86 D, 276/85 H; 124/60, 62; 104/155, 156, 161; 243/3, 17, 32, 33, 39; 302/2 R

[56] References Cited

U.S. PATENT DOCUMENTS

| | | | |
|---|---|---|---|
| 839,646 | 12/1966 | Roberts | 243/17 |
| 2,890,537 | 6/1959 | Benko | 46/44 UX |
| 3,469,340 | 9/1969 | Breneman et al. | 46/44 |
| 3,495,546 | 2/1970 | Brown et al. | 104/155 |
| 3,734,428 | 5/1973 | Alexandrov et al. | 243/39 X |
| 3,949,953 | 4/1976 | Hopkins | 243/3 |

FOREIGN PATENT DOCUMENTS

| | | | |
|---|---|---|---|
| 2011887 | 9/1971 | Fed. Rep. of Germany | 243/32 |
| 208199 | 1/1940 | Switzerland | 124/62 |

*Primary Examiner*—F. Barry Shay

*Attorney, Agent, or Firm*—Robert P. Seitter; John W. Logan, Jr.

[57] ABSTRACT

The preferred embodiment of the invention disclosed herein relates to a toy system comprising a generally closed track arrangement and a toy vehicle adapted to be propelled in the track by a pressurized fluid. The track arrangement is preferably a series of transparent tubular members interconnected to form any desired track configuration. One of the tubular members includes a pressurized fluid inlet opening adapted to be coupled to pressurized fluid source and further includes check valve means and an exhaust opening. The check valve means is located on the upstream side of the inlet opening and closely adjacent thereto; the exhaust opening is located on the upstream side of the check valve means and is closely adjacent thereto. The toy vehicle can be in any desired shape loosely fitting within the tubular members and includes, at its tail end, flexible seal means which engages the inner periphery of the tubular track members to prevent the flow of pressurized fluid around the vehicle.

5 Claims, 4 Drawing Figures

PNEUMATIC VEHICLE WITH CENTRALLY MOUNTED GUIDE MEANS

This application is a continuation-in-part of abandoned application Ser. No. 730,337, filed Oct. 7, 1976.

This invention relates to a toy system and, more particularly, to a toy vehicle system including a track arrangement and a toy vehicle adapted to be propelled along the track arrangement by pressurized fluid.

Several types of toy vehicle systems including a track arrangement and a toy vehicle arranged to be propelled along the track are known in the art. Some of these systems include electric motor arrangements in the toy vehicle and conductive tracks connected to a voltage source for driving the vehicle therealong. Electric systems of this type are relatively expensive requiring motors, gearing and usually a transformer to power the vehicle. As a more economical alternative, certain fluid propelled systems are also known in the art. Usually the fluid propelled systems include a blower or other suitable source of pressurized fluid for directing pressurized fluid, usually air, against the back of a vehicle carried in a closed track arrangement. The pressurized air then drives the vehicle along the track arrangement. While these systems are somewhat less expensive than the electric systems, they suffer from a variety of problems which impair the efficiency of the system. The main problem relates to the fact that the toy vehicle must fit loosely in the track member in order to negotiate turns and loops in the track arrangement. Thus the pressurized air passes between the vehicle and the track members so that some of the air provides no force. In addition this air can build up on the upstream side of the vehicle and resist its movement.

Accordingly, it is an object of this invention to provide a toy system including a track arrangement and a toy vehicle adapted to be propelled along the track arrangement by fluid pressure in a relatively economical and efficient manner.

It is another object of this invention to provide a track member for use in a toy system which includes an inlet opening for pressurized fluid, check valve means and an exhaust opening all of which are located to provide for the efficient, high speed movement of a vehicle through a track arrangement.

It is yet another object of this invention to provide a toy vehicle adapted to be driven in a track arrangement by fluid pressure which vehicle is relatively inexpensive and highly efficient in that it maximizes the propulsion force.

Finally, it is an object of this invention to provide a toy system including a closed track arrangement and a toy vehicle driven along the track arrangement by pressurized air which acts throughout the substantially entire length of the track arrangement to provide relatively high velocities for the toy vehicle.

These and other objects of this invention are accomplished by providing a track arrangement preferably made of transparent tubular members adapted to be interconnected. One of the tubular members includes a pressurized fluid inlet opening adapted to be coupled to a fluid pressure source which provides for a stream of pressurized fluid flow through the track arrangement, a check valve means having a normally closed position located on the upstream side of the inlet opening and an exhaust opening located on the upstream side of the check valve means. The check valve means is located closely adjacent the inlet opening and the exhaust opening is located closely adjacent the check valve means.

The toy vehicle utilized with the track arrangement described above can have any desired configuration but is preferably slightly smaller than the inner diameter of the tubular members so that the vehicle may negotiate turns and loops in the track configuration. At the backside of the vehicle there is provided flexible seal means which is adapted to engage the inner periphery of the tubular members and which is relatively flexible so that contact is maintained when the vehicle is travelling through turns and loops. With the seal means the flow of pressure fluid around the car is prevented and a maximum working area is provided for propelling the car along the track.

In addition, the toy vehicle includes guide means on its outer periphery that rides on the inner surface of the tubular members. The guide means is in the form of a plurality of wheel members mounted on the periphery of the car adjacent its center of gravity.

For a better understanding of the invention, reference is made to the following description of a preferred embodiment thereof taken in conjunction with the figures of the accompanying drawing, in which.

Figure 1:
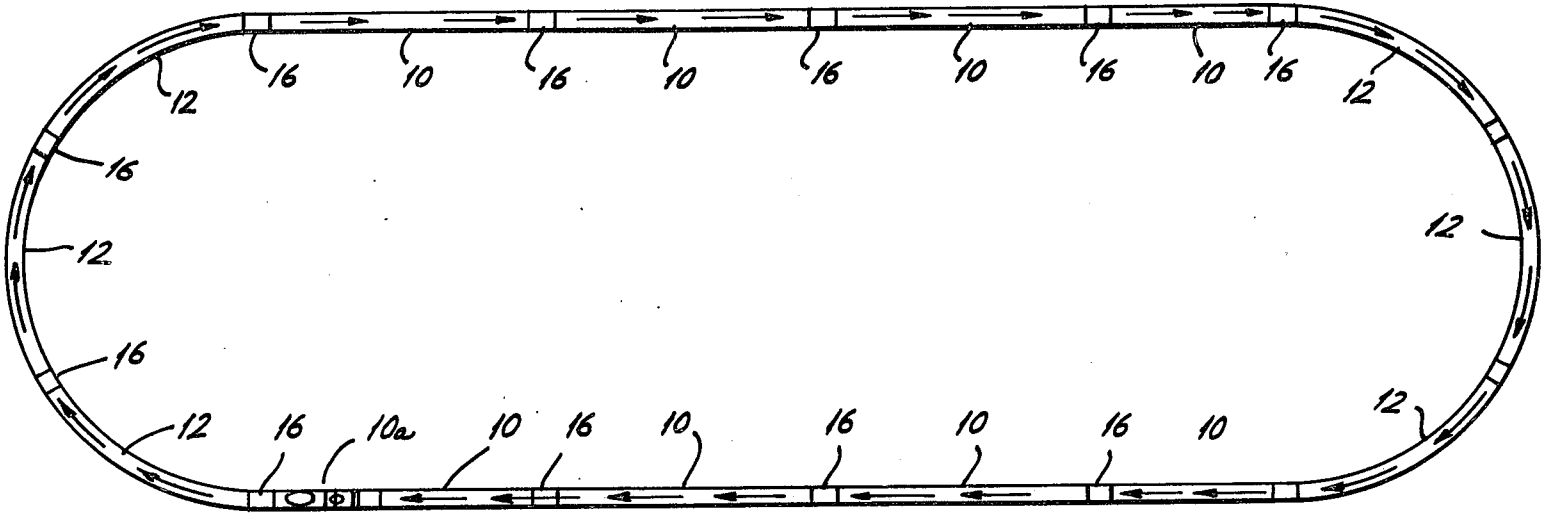
FIG. 1 is a plan view of a track arrangement in accordance with the present invention.

Referring to FIG. 1, there is illustrated an oval track arrangement comprised of a plurality of tubular track members, both straight members 10 and 10*a* and curved members 12 arranged to form a closed oval track. It should be understood, however, that any desired track configuration can be provided including various turns and loops.

The track members 10, 10*a* and 12 are tubular and thus have a circular cross-section and are transparent so that users of the toy can see a toy vehicle 14 within the members when the vehicle is propelled therethrough. To couple the track members together any of a variety of conventional arrangements can be provided. As illustrated in the drawing coupler members 16 are provided which frictionally receive the ends of adjacent track members.

Figure 2:
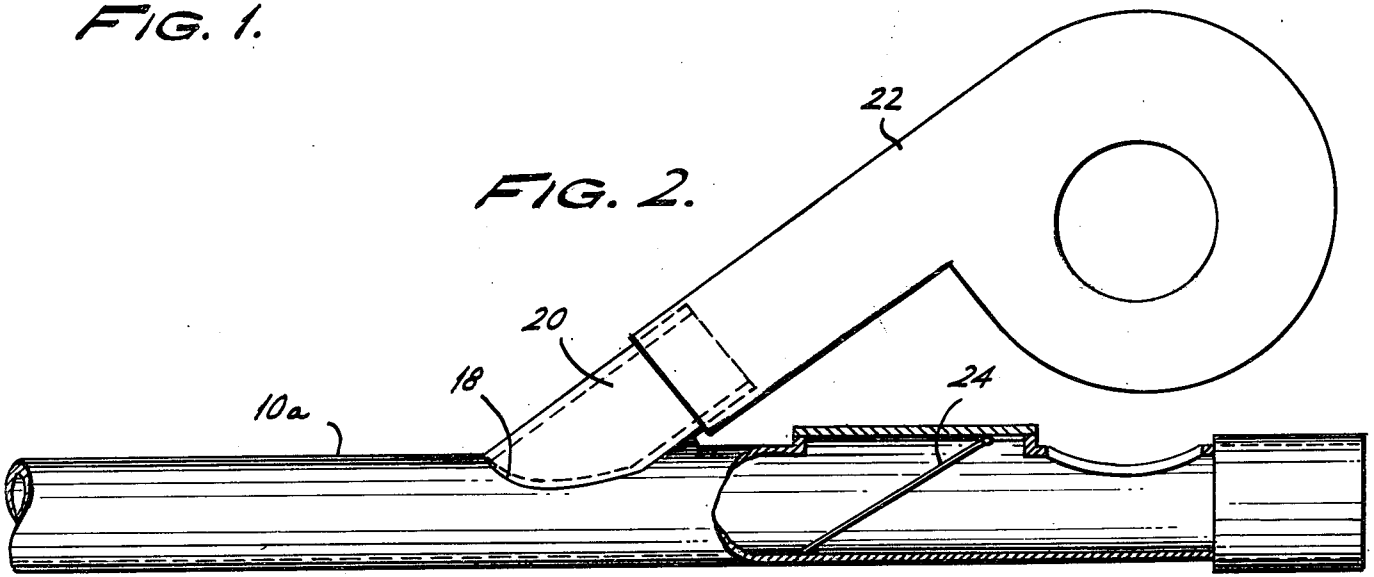
FIG. 2 is a partial sectional view illustrating one of the track members in the track arrangement.

Referring to FIG. 2, track member 10*a* is illustrated and can be seen to include an inlet opening 18 formed at the outer periphery of the member and communicating with a short tubular branch member 20 which is connected to a conventional centrifugal blower 22. The blower 22 forces pressurized air through the tubular branch member 20, the inlet opening and then through the various tubular members 10 and 12 forming the track arrangement. The short tubular branch member 20 is joined to the track member 10*a* at an acute angle so that the members form a Y configuration. Because of the Y configuration the pressurized air is initially directed in the upstream direction of the track arrangement, shown by the arrows and minimizes turbulence of the air adjacent the inlet opening 18. For convenience the side of the track member 10*a* from which air is discharged will be referred to as the downstream side and the side in which air is received will be referred to as the upstream side. While the preferred embodiment of the invention utilizes a blower and air, various pressure sources and fluid can be utilized in accordance with this invention.

In addition, the track member 10*a* includes a check valve 24 which extends across the tube at an acute angle and which conforms to the inner periphery of the track member 10*a* when it is in its closed position. The check valve 24 is pivoted at the top of the track member 10*a* so that air flow is confined to the downstream direction of the track member 10*a*. Normally, the check valve 16 is closed being pivoted downwardly under its own weight and air pressure on the face adjacent the air inlet opening 18 acts to keep the check valve closed. In the closed position the check valve 24 keeps the air flow in the desired direction. As should be clear, however, the check valve means 24 is opened by force exerted on the side opposite the inlet opening 18 which force is exerted by the toy vehicle 14 so that the vehicle can pass the check valve means and continue its movement along the track arrangement.

In addition, the track member 10*a* includes an exhaust opening 26 adjacent the upper periphery and closely adjacent to the check valve 24 on the upstream side. The exhaust opening allows the air in the track arrangement to escape so that air pressure does not build up and resist movement of the toy vehicle 14. It should be noted that without the vent opening the air pressure could act and prevent movement of the toy vehicle. A valve member 28 is associated with the exhaust opening 26 for controlling its size and thus the air flow therethrough. In this way the speed of the toy vehicle 14 can be controlled. The larger the opening, the faster the vehicle 14 moves. Conveniently the valve member 28 can be in the form of a ring member having a sufficient axial extent to completely cover the exhaust opening 26. By sliding the ring member back and forth, the size of the exhaust opening 26 can be controlled.

At this point it is noted that the space between the inlet opening 18 and the check valve means 24 and the exhaust opening 26 should be as small as possible to minimize the dead spot in the track arrangement, that is, the space along which no air acts to propel the vehicle. It should be clear that after the vehicle 24 passes the exhaust opening 26 the air escapes and does not act to propel the vehicle; after the vehicle passes the check valve 24, air acts against the movement of the vehicle. Thus, by minimizing the space between the air inlet 18 and the check valve 24 and exhaust opening 26, the momentum of the vehicle will carry it through the dead spot until it again reaches the inlet 18 where the air again acts to propel the vehicle.

Figure 3:
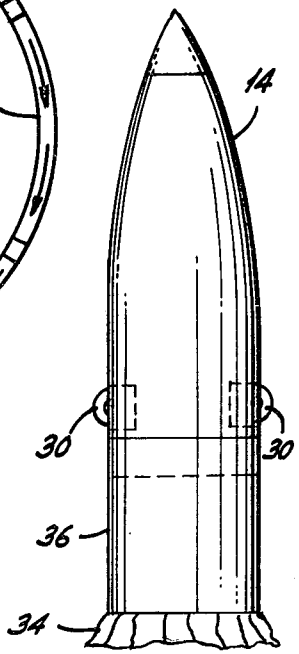
FIG. 3 is a side elevation view of a toy vehicle utilized with the track arrangement illustrated in FIGS. 1 and 2; and, FIG. 4 is a front elevation view of the toy vehicle illustrated in FIG. 3.
Figure 4:
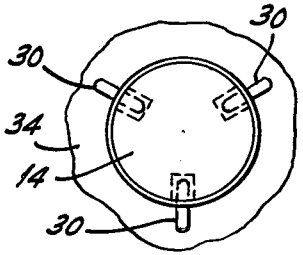

Referring to FIGS. 3 and 4 of the drawing, the toy vehicle 14 is illustrated and comprises a body member of any desired shape. The preferred embodiment of the invention utilizes a missile shape because of its obvious aerodynamic advantages. The toy vehicle 14 can be made of any relatively light-weight material such as plastic or wood and has a cross-sectional size smaller than the inner diameter of the track members 10 and 12 such that the toy vehicle during its travel can negotiate the turns, loops and other bends in the configuration of the track arrangement.

Guide means are provided with the vehicle 14 and preferably includes a plurality of wheels 30 spaced equally around the outer periphery of the vehicle and which are located radially adjacent its center of gravity. Preferably three wheels define a circle having a diameter less than that of the inner periphery of the track members so that the vehicle rides on only one or two of the wheels. Thus, in a turn the vehicle rides on the portion of the track members adjacent the outer periphery of the turn. In this respect the wheels can be mounted in recesses 34 formed in the vehicle 14. By locating the guide means radially adjacent the center of gravity, the vehicle tends to maintain a nearly parallel orientation with respect to the straight track members 10 and 10*a* so that neither the front nor the tail end of the vehicle drags on the inner periphery of the track.

To enhance the efficiency of the vehicle 14 as it runs through the track, there is also provided in accordance with this invention a flexible seal member 34 attached to the tail end of the vehicle. The seal means 34 is preferably a thin flexible diaphragm member, similar to a membrane, having a generally frustoconic shape such that its smaller end is attached to the vehicle and its larger end engages the inner periphery of the track members 10, 10*a* and 12. The attachment of the seal means 34 to the vehicle can be effected by securing the seal means to a cylindrical shround 36 and by placing the shround on a reduced diameter position of the vehicle. With the flexibility of the seal means 34, it can conform to the inner periphery of the track members 10, 10*a* and 12 and by making the diameter at the larger end larger than the inner periphery of the track members, the seal means can conform to the track while the vehicle negotiates turns and thus maintain sealing contact. The seal means is operative to minimize the flow of air around the car which could build up and resist movement of the car and also maximizes the area over which the air acts to propel the car. Accordingly, maximum velocities for the car can be achieved. Some leakage around the seal usually occurs and is helpful in controlling and reducing the speed of the vehicle by allowing a small pressure buildup upstream of the vehicle while reducing pressure downstream of the vehicle.

While in the foregoing a preferred embodiment of the invention has been described, it should be realized that various changes and modifications can be made without departing from the true spirit and scope of the invention as recited in the appended claims.

We claim:

1. A toy vehicle adapted to be propelled through a track arrangement by pressurized fluid, said vehicle comprising a body member made of generally light-weight material and having a cross-section smaller than the inner periphery of the track arrangement, seal means attached to one end of said body member for engaging the inner periphery of the track arrangement and minimizing the passage of pressurized fluid around the vehicle, said seal means comprising a thin flexible diaphragm having one end carried on one end of the body member, the other end of said diaphragm having a diameter slightly larger than the inner periphery of the track arrangement whereby pressurized fluid expands the seal against the inner periphery of the track arrangement and guide means circumferentially spaced around the periphery of said body member for guiding said vehicle relative to the inner periphery of the track arrangement, said guide means being restricted to the area of said body member portion radially adjacent the center of gravity of said body member.

2. A toy vehicle in accordance with claim 1 wherein said diaphragm is similar to a membrane.

3. A toy vehicle in accordance with claim 1 wherein said diaphragm has a frusto-conic shape.

4. A toy vehicle in accordance with claim 2 wherein said guide means includes a plurality of wheels mounted at the periphery of said body member, said wheels defining a circle having a diameter smaller than that of the track arrangement.

5. A toy vehicle in accordance with claim 1 including a plurality of wheels mounted at the periphery of said body member adjacent the center of gravity thereof, said wheels defining a circle having a diameter less than that of the track arrangement.

* * * * *